United States Patent [19]

Theyskens

[11] 4,392,574

[45] Jul. 12, 1983

[54] TOWER CRANE

[76] Inventor: Karel H. A. Theyskens, Burgemeester Geyskensstraat 4, B - 3950 Beringen, Belgium

[21] Appl. No.: 250,125

[22] Filed: Apr. 2, 1981

[30] Foreign Application Priority Data

Apr. 18, 1980 [BE] Belgium ..... 58514

[51] Int. Cl.[3] ..... B66C 23/64

[52] U.S. Cl. ..... 212/225; 212/228; 212/257; 212/267

[58] Field of Search ..... 187/9 E; 212/225, 230, 212/231, 257, 264, 267, 228; 52/118

[56] References Cited

U.S. PATENT DOCUMENTS

| | | | |
|---|---|---|---|
| 3,154,025 | 10/1964 | Worthington | 212/161 |
| 3,249,236 | 5/1966 | Kummerman | 212/15 |

FOREIGN PATENT DOCUMENTS

| | | | |
|---|---|---|---|
| 1812805 | 6/1970 | Fed. Rep. of Germany . | |
| 2102737 | 7/1971 | Fed. Rep. of Germany | 212/228 |
| 1966093 | 11/1971 | Fed. Rep. of Germany . | |
| 2138923 | 2/1972 | Fed. Rep. of Germany | 212/231 |
| 2413991 | 9/1974 | Fed. Rep. of Germany | 212/228 |
| 360883 | 5/1906 | France . | |
| 463533 | 12/1913 | France . | |
| 510029 | 8/1920 | France . | |
| 1449567 | 10/1968 | France . | |
| 2111998 | 6/1972 | France . | |
| 2122583 | 9/1972 | France . | |
| 2190711 | 2/1974 | France . | |
| 182882 | 9/1966 | U.S.S.R. | 212/267 |

*Primary Examiner*—Trygve M. Blix
*Assistant Examiner*—Thomas J. Brahan
*Attorney, Agent, or Firm*—Stevens, Davis, Miller & Mosher

[57] ABSTRACT

A first cable portion runs from the crab over a pulley at the point of the jib point part to the winch on the foot part. A second cable portion runs from the crab over a pulley at the end lying on the pylon side, of the jib foot part, over a pulley mounted on the end removed from the pylon, of said jib foot part, round two pulleys on the end facing the pylon of the jib point part, over a pulley at the end removed from the pylon, of the jib foot part to the winch.

3 Claims, 1 Drawing Figure

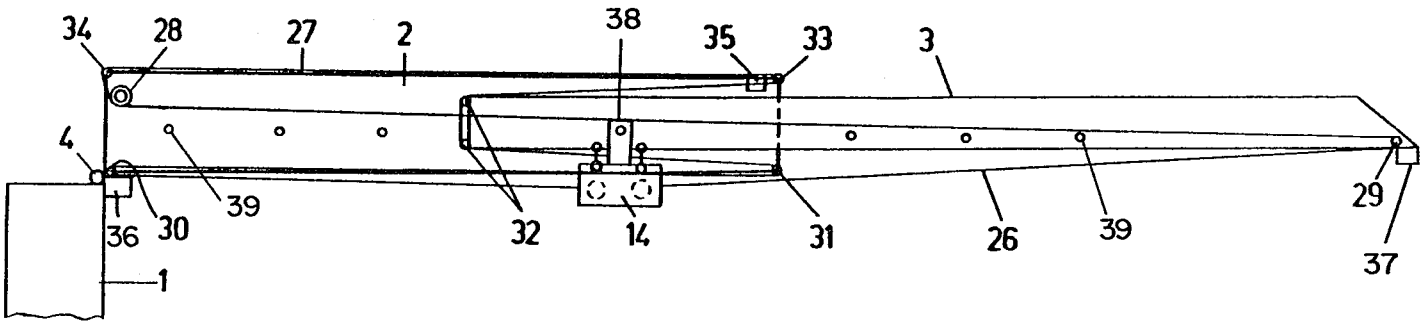
37
29
39
26
3
33
31
35
38
14
32
2
27
39
28
30
1
36
34
4

TOWER CRANE

BACKGROUND OF THE INVENTION

This invention relates to a tower crane which comprises a pylon and a telescopic jib with travelling crab mounted thereon, which jib comprises at least two slidable jib parts, namely a foot part fastened to said pylon and a slidable point part, which parts each have a runway extending along the lengthwise direction thereof for the travelling crab, which jib has means to lock both said jib parts relative to one another, which crane is provided with a winch and a cable made fast thereto for sliding said jib in and out as well as for traversing said travelling crab over the jib, a first cable portion which can move the crab away from said pylon, being made fast to said travelling crab and running over at least one cable pulley mounted on that end removed from the pylon of the jib point part to the winch, and a second cable portion which can move said crab towards the pylon, also being made fast to said travelling crab and running over ar least one cable pulley mounted on that end lying on the pylon side of the jib foot part to the winch, whereby both cable portions are so wound on the winch drum that as the one portion is wound on said drum, the other portion is unwound therefrom.

In known tower cranes of this kind, the first cable portion runs from that cable pulley on that point part end removed from the pylon, towards said pylon up to a cable pulley which is mounted on that point part end facing the pylon, then back away from the pylon and about a cable pulley which is mounted on that end removed from said pylon, of the jib foot part. Said first cable portion runs finally up to the pylon, either directly to said winch when same is mounted on the jib foot part, or over a cable pulley mounted on said foot part against said pylon, to the lower side of said pylon or the stand which bears said pylon, when the winch is mounted thereon. The second cable portion runs from the travelling crab directly to that end lying on the pylon side, of the jib foot part and is made fast there to said winch when same is mounted on said foot part, or runs there over a pulley mounted on said foot part to the lower side of the tower crane when said winch is is mounted at the bottom of said crane.

In such known cranes, the first cable portion can move said travelling crab away from the pylon while the jib is retracted and the jib parts are connected together. Once the travelling crab has reached that end removed from the pylon, of the jib foot part, the jib parts are uncoupled from one another, while the travelling crab is automatically coupled to the jib point part. By means of said first cable portion, the jib may now be extended, whereby the travelling crab thus moves together with the jib point portion. To retract the jib again, the travelling crab has first to be locked again on the free end of the jib point part. By means of the second cable portion the travelling crab is pulled towards the pylon whereby thus the jib point part retracts into the foot part. When said point part is completely retracted, the jib parts are automatically locked together, but the travelling crab is automatically released from the point part, in such a way that said travelling crab can now be moved over the jib foot part by means of the second cable portion. In the extended position of the jib, the travelling crab after being uncoupled from the point part, can be moved but only over said point part.

Due to the devices required for coupling and uncoupling the travelling crab relative to said jib point part, besides the already required device for coupling together the jib parts, such known tower cranes are quite expensive. Moreover the use of such a tower crane is not very flexible as the load cannot be moved over the whole length of the extended jib without sliding in and out said jib according to the movement direction of said load.

The invention has now for object to obviate the above drawbacks and provide a tower crane which comprises a pylon and a telescopic jib mounted thereon with a travelling crab, whereby said crab can move in a very simple way, both with a completely extended jib and with a completely retracted jib, as well as in various intermediate positions of said jib, over the whole jib length without having to slide in or out said jib, while neither for the sliding out nor for the sliding in of the jib, intricate locking mechanisms are required for locking the travelling crab.

THE INVENTION

For this purpose, the first cable portion runs over the cable pulley at that end removed from the pylon, of the jib point part directly towards the pylon, at least to the jib foot part, in such a way that said cable portion cannot only traverse the travelling crab towards that end removed from the pylon, of the jib but also, when the displacement of the travelling crab in the direction of that end removed from the pylon, of the jib point part is prevented, can pull said point part inside the foot part of the jib, while the second cable portion first runs over the cable pulley at that end lying on the pylon side, of the jib foot part, but thereafter runs back away from said pylon to a cable pulley which is mounted on that end removed from the pylon, of said jib foot part, round said pulley back to the pylon, over at least one cable pulley on that end facing the pylon of the jib point part, thereafter again away from the pylon, and finally over a second cable pulley which is mounted at that end removed from the pylon, of the jib foot part, back towards the pylon, in such a way that said second cable portion cannot only move said travelling crab towards the pylon but also, when the displcement of the travelling crab in the direction of that end lying on the pylon side, of the jib foot part is prevented, can extend the jib point part out of said foot part.

Both when sliding in and when sliding out the jib, the travelling crab can lie at one end of said jib, while that cable portion connected to said travelling crab which controls the sliding-in and the sliding-out of the jib, pulls in that direction opposite to the sliding direction of the jib point part, in such a way that it is but necessary to retain the travelling crab against a stop at the jib end and no special connectable and disconnectable mechanism is required to couple the travelling crab with the jib. The sliding in or out of the jib may also occur when the travelling crab does not lie at one end of said jib, but then said crab has to be locked on the one jib part. A simple locking mechanism, for example to be remotely controlled by hand, may be used therefor. In any case, the travelling crab can always be moved over the complete jib length, without having to slide the jib in or out, whatever also be the sliding position of said jib.

In a particular embodiment of the invention, the winch is mounted on that end lying on the pylon side, of the foot part from the jib proper and the ends running to the foot part of said jib, from both cable portions are made fast on said foot part end directly to the winch drum.

In a particular embodiment of the invention, both cable portions are discrete parts which are each made fast with the one end thereof, to the travelling crab and which are wound with the other end thereof in opposite directions on the winch drum and made fast to said drum.

Other details and advantages of the invention will stand out from the following description of a tower crane and a telescopic jib used therewith, according to the invention; this description is only given by way of non limitative example and with reference to the accompanying drawing.

THE DRAWING

The single FIGURE is a diagrammatic side view from part of a tower crane according to the invention.

DESCRIPTION OF THE PREFERRED EMBODIMENT

The tower crane as shown in the FIGURE is of known structure, to the exception of the telescopic jib. Said crane will consequently only be described as far as necessary to make the invention clear.

In the usual way, the tower crane according to the invention also comprises a pylon 1 which may also be telescopic, and which is mounted either fixedly or tiltably on an underframe not shown in the FIGURE.

At the top end thereof, said pylon 1 bears the jib which is comprised of a foot part 2 and a point part 3 which is slidable in and out relative to said foot part 2. Said foot part 2 can be made fast fixedly, rotatably or as shown hingedly by means of a hinge 4, to the top of pylon 1. The pulling up of the hinged jib occurs in a known way with a cable not shown in the FIGURE, which is fastened on the one hand to the foot part 2 and on the other hand, runs over a cable pulley on a tower to a winch. Said winch is not shown in the FIGURE, nor the tower which is for example hingedly connected to that end lying on the pylon side, of the foot part 2.

The pylon 1 is made in the usual way from a metal lattice not shown in the FIGURE. Both parts 2 and 3 from the jib are also made from metal latticework which has not been shown in the FIGURE for clearness sake.

The foot part 2 forms a reverse U-shaped trough which is completely open on the lower side.

The point part 3 from the jib 2, 3 forms a sidewise-closed lattice box which has a substantially triangular cross-section and which fits inside the above-mentioned trough formed by said foot part 2.

The travelling crab 14 hangs from the foot part 2 and/or point part 3 of said jib 2, 3 by means of two roller sets which cooperate respectively with a runway from foot part 2 and with a runway from point part 3.

In the extended condition of the jib, the travelling crab 14 can run without obstacle over the whole jib length. The passage from the one jib part to the other occurs uniformly, without bumps, as a roller set runs on the runway from the one part and the other roller set moves in the extension of the supporting surface of the runway from the other jib part.

The sliding in and out of jib 2, 3 and the running of crab 14 occurs by means of one and the same cable which is comprised of two cable portions 26 and 27, and which is driven by which 28. Said winch 28 is of a structure known per se and is thus comprised in the usual way of a drum and a drive motor connected thereto. The winch 28 is mounted on that end lying on the pylon side, of jib foot part 2.

Both cable portions 26 and 27 are made fast with the one end thereof to the point side and the pylon side respectively, of travelling crab 14. Both cable portions 26 and 27 may form two discrete cables, in which case the other ends thereof are fastened to the drum of winch 28. At said ends, both cable portions 26 and 27 are wound over a length thereof in opposite direction on the drum of winch 28, in such a way that with said drum rotating, the one cable portion is wound on the drum and the other cable portion is unwound therefrom. Both cable portions can also form a single piece which is wound over some length on the drum of winch 28. Actually it is equivalent to said latter ends of the cable portions being made fast to the winch drum because said ends are connected together and wound about the drum, whereby thus also there is obtained that the one cable portion is made shorter during the winch drum rotation at the same rate as the other cable portion is made longer.

Said first cable portion 26 runs from the travelling crab 14, first to the point of point part 3 of the jib, passes over a cable pulley 29 mounted on said point and then returns towards pylon 1, directly to winch 28. The second cable portion 27 runs from travelling crab 14 first towards pylon 1, over a cable pulley 30 which is mounted on that end lying on the side of pylon 1, of jib foot part 2, back away from pylon 1, over a cable pulley 31 which is mounted on that end removed from pylon 1, of said foot part 2, thereafter back toward pylon 1 and over two cable pulleys 32 mounted on that end facing pylon 1, of jib point part 3, away from pylon 1 to that end removed from pylon 1, of said foot part 2, about a cable pulley 33 mounted on said end back towards pylon 1, and finally over a cable pulley 34 mounted on that end lying on the side of pylon 1, of said foot part 2, to the winch 28.

Both jib parts 2 and 3 can be locked relative to one another in a number of positions, by means of an electric coupling device 35. Such coupling devices are known per se. The coupling device may for example be comprised of an electromagnetically-operated bolt which is mounted on the one jib part and cooperates with openings which are provided in the other jib part. Said bolt is for example mounted on that end removed from pylon 1, of foot part 2, while jib point part 3 is provided with a number of openings therefor. Said openings are so arranged that in the completely retracted condition of point part 3, in the completely extended condition of point part 3, and in a number of intermediate positions, the bolt from said device 35 can enter and leave one opening from said point part 3 to couple or uncouple said jib parts relative to one another. The bolt from the coupling device 35 is, as well as winch 28, remotely controlled by the operator of the tower crane.

The sliding in and out of jib 2,3 and the running of travelling crab 14 occurs as follows:

When the jib is completely retracted, it is posssible by means of cable portions 26 and 27, depending on the rotation direction of the drum from winch 28, to move said travelling crab 14 to-and-fro over both jib 2,3 telescoped into one another, both jib parts are preferably locked together therefor, as even with a possible jamming of said travelling crab 14, no extension of the jib should occur.

When the travelling crab 14 lies at that end lying on the side of pylon 1, of foot part 2, one can after uncoupling from one another both jib parts 2 and 3, by means of cable portion 27 and by winding said cable portion on the drum of winch 28, extend said jib point part 3. Actually said cable portion 27 pulls the travelling crab further on towards said pylon 1, which is however impossible due to said travelling crab 14 already lying at the end of foot part 2 and being unable to move further due to a stop 36 mounted on said end. Said cable portion 27 can thus as it is shortened, but push outwards that end lying inside foot part 2, of the point part 3.

When said point part 3 cannot be pushed further outwards, either because said point part is already extended to the maximum or because the point part 3 has been retained by said coupling device 35 being operated before the complete extension of said point part 3, the travelling crab 14 may now be run over the complete jib completely or partly extended, by winding cable portion 26 on the drum of winch 28. By means of cable portion 27, the travelling crab may be run back in the other direction over the whole jib length. It is clear that said jib parts 2 and 3 have to be provided with the required stops to limit the extension of point part 3, or that with the maximum extension, the coupling device 35 or some other coupling device should automatically operate. To prevent that when winding cable portion 26, with a possible jamming of travelling crab 14, said point part 3 would slide back in, it is to be preferred after the extension of said point part 3, to lock same relative to jib foot part 2 by means of said coupling device 35.

To retract now point part 3 inside foot part 2, the travelling crab is first run to the point of point part 3 by winding cable portion 26. It is clear that said point part 3 is provided at the tip thereof with a stop 37 to retain said crab 14 on said tip. Once the travelling crab 14 engages said stop, it is possible by further winding of cable portion 26 on the drum of which 28, after uncoupling jib parts 2 and 3 from one another, to slide jib point part 3 inside part 2.

Due to the course of cable portions 26 and 27, the retracting of the jib occurs at the same rate as the running of travelling crab 14, while the extending of the jib occurs at half said rate. Both in the retracted condition and in the completely or partly extended condition of the jib, the travelling crab 14 can always be run over the whole jib length. No locking whatsoever of said travelling crab is required, neither by the extending nor by the retracting of the jib. The travelling crab 14 is retained in either case by the stop which is required anyway at the jib end, while that cable portion which insures the sliding in or out, further pulls said crab 14 against said stop.

In a variation of the above-described tower crane, said crane may however still be provided with one or a plurality of locking mechanisms which prevent the displacing of the travelling crab towards the pylon over the jib foot part, or away from the pylon over the jib point part. In this embodiment, it is then no more required that when sliding the jib in or out, the travelling crab should lie at the pylon end or the point end respectively, of the jib. The jib may also be extended by retaining the travelling crab on the foot part by means of a locking mechanism and the jib may also be retracted by retaining said travelling crab on the point part by means of a locking mechanism. Such locking mechanisms may be remotely operated manually and may have a very simple structure. The sliding in and out of the jib occurs at the same rate as in the previously described embodiment.

Instead of two locking mechanisms which retain the travelling crab respectively on the foot part and the point part of said jib along one direction, the tower crane may comprise one or two locking mechanisms which can prevent the movement of said travelling crab in both movement directions. Such a locking mechanism may for example be similar to the above-described coupling device 35 whereby the bolt 38 may be mounted on the travelling crab 14, while the openings 39 may be provided in the foot part 2, in the point part 3 or in both.

By locking with such a locking mechanism the travelling crab at the same time in both running directions relative to foot part 2, it is possible to slide both in and out said point part 3, whereby such sliding in and out occurs at a rate which is equal to half the speed with which the travelling crab moves during the displacement thereof over the jib 2, 3.

When to the contrary and by means of such a locking mechanism, the travelling crab 14 is locked at the same time in both running directions on point part 3 from said jib 2, 3, it is also possible to slide said point part 3 both in and out, but with a rate which is then the same as the normal running speed of travelling crab 14.

The tower crane is of course further provided in the usual way with a hoisting cable which is controlled by a discrete winch. Said winch may be example to arranged at the bottom of said tower crane, whereby then the hoisting cable runs upwards over a cable pulley mounted at the top of pylon 1, towards the travelling crab where said cable runs in the usual way about the cable pulleys thereof, and thereafter about a cable pulley mounted on the other end of said point part, and finally about said latter cable pulley to that end removed from pylon 1, of the foot part 2 where said cable is then made fast.

The winch for displacing that cable for sliding in and out the jib and for running the travelling crab does not have necessarily to be mounted on the jib. Said winch may also be mounted on the pylon or on the underframe thereof. In the latter case, the same winch may comprise a plurality of drums which can be coupled together, whereby said cable is wound on the one drum, while another drum can move the hoisting cable and possibly further drums can move the cable for pulling up the pylon and a cable for adjusting the slope of the jib relative to the pylon.

When the winch is mounted on the pylon end of the jib, the cable pulley on said pylon end for the second cable portion, which can move the travelling crab towards the pylon, is not absolutely required. Said cable portion can run directly to the winch drum.

The telescopic jib may also be comprised of more than two parts. In the case of three parts, the centre part is to be considered as said foot part relative to the point part, bus as said point part relative to that part which is made fast to the pylon.

I claim:

1. Tower crane comprising:

a pylon, a telescopic jib which comprises at least two jib parts slidable relative to each other, namely a foot part fastened to said pylon and a slidable point part, which parts each have a runway extending along the lengthwise direction thereof, a crab mounted on the jib and movable on each runway, means to lock both said jib parts relative to one another, a winch mounted adjacent to the foot part of the jib, a cable pulley mounted on the end removed from the pylon of the jib point part, at least one cable pulley mounted on the end lying on the pylon side of the jib point part, two cable pulleys mounted on the end removed from the pylon of the jib foot part, a cable pulley mounted on the end lying on the pylon side of the jib foot part, a stop mounted on the foot part for stopping the movement of the travelling crab in the direction of the pylon, a stop mounted on the point part for stopping the movement of the travelling crab in the direction of the jib end removed from the pylon, and, a cable for sliding said jib in and out as well as for traversing said travelling crab over the jib, said cable comprising two cable portions so connected to the winch that when one cable portion is wound up the other is unwound, both portions being connected to the travelling crab, one cable portion running from the crab over the cable pulley at that end removed from the pylon, of the jib point part to the winch, while the other cable portion runs from the crab over the cable pulley at that end lying on the pylon side, of the jib foot part, but thereafter runs back away from said pylon to one of the cable pulleys which are mounted on that end removed from the pylon, of said jib foot part, round said pulley back toward the pylon, over said cable pulley on that end facing the pylon of the jib point part, thereafter again away from the pylon, and finally over the second cable pulley which is mounted at that end removed from the pylon, of the jib foot part, back towards the pylon and to the winch.

2. Tower crane as defined in claim 1, in which the travelling crab comprises two roller sets which cooperate respectively with the runway from the foot part of the jib and with the runway from the point part of the jib.

3. Tower crane as defined in claim 1, which comprises at least one locking mechanism for locking the travelling crab simultaneously in both running directions relative to the jib in such a way that the jib point part can be retracted as well as extended when the travelling crab is being retained on the one jib part in both running directions, by means of said locking mechanism.

* * * * *